US007611429B2

(12) United States Patent
O'Neill et al.

(10) Patent No.: US 7,611,429 B2
(45) Date of Patent: Nov. 3, 2009

(54) INFLATABLE ARTICLES THAT PROVIDE LONG TERM INFLATION AND PRESSURE CONTROL

(75) Inventors: Michael O'Neill, Middletown, DE (US); Donald Allan Sandusky, Landenberg, PA (US)

(73) Assignee: Primo Research, Inc., Newark, DE (US)

( * ) Notice: Subject to any disclaimer, the term of this patent is extended or adjusted under 35 U.S.C. 154(b) by 186 days.

(21) Appl. No.: 11/363,618

(22) Filed: Feb. 28, 2006

(65) Prior Publication Data

US 2006/0205547 A1 Sep. 14, 2006

Related U.S. Application Data

(60) Provisional application No. 60/657,368, filed on Mar. 1, 2005, provisional application No. 60/658,094, filed on Mar. 3, 2005, provisional application No. 60/695,582, filed on Jun. 30, 2005, provisional application No. 60/695,768, filed on Jun. 30, 2005, provisional application No. 60/697,701, filed on Jul. 8, 2005.

(51) Int. Cl.
*A63B 41/00* (2006.01)

(52) U.S. Cl. ..... 473/604; 473/594

(58) Field of Classification Search ..... 473/593–595, 473/603–605, 609–611; 152/511, 512
See application file for complete search history.

(56) References Cited

U.S. PATENT DOCUMENTS

| | | | | | |
|---|---|---|---|---|---|
| 1,402,682 | A | * | 1/1922 | Takashima | 473/601 |
| 1,649,458 | A | * | 11/1927 | Fewlass | 473/597 |
| 2,364,247 | A | * | 12/1944 | Shearer | 473/610 |
| 2,524,546 | A | * | 10/1950 | Sinclaire | 473/595 |
| 3,107,683 | A | * | 10/1963 | Vergara Ochoa | 473/610 |
| 3,768,501 | A | | 10/1973 | Elson et al. | |
| 4,098,504 | A | | 7/1978 | Koziol et al. | |
| 4,192,044 | A | * | 3/1980 | Ballerini | 473/575 |
| 4,300,767 | A | | 11/1981 | Reed et al. | |
| 4,340,626 | A | | 7/1982 | Rudy | |
| 4,358,111 | A | | 11/1982 | Papinsick et al. | |
| 4,399,851 | A | * | 8/1983 | Bschorr | 152/156 |
| 4,513,803 | A | | 4/1985 | Reese | |
| 4,568,081 | A | * | 2/1986 | Martin | 473/611 |
| 4,842,563 | A | * | 6/1989 | Russell | 473/610 |
| 5,227,103 | A | | 7/1993 | Muschiatti | |
| 5,261,661 | A | * | 11/1993 | Lemmon | 473/438 |
| 5,342,043 | A | * | 8/1994 | Baltronis et al. | 473/599 |
| 5,356,430 | A | | 10/1994 | Nadol, Jr. | |
| 5,403,003 | A | * | 4/1995 | O'Hara et al. | 473/576 |
| 5,578,085 | A | | 11/1996 | Johnson, Jr. et al. | |
| 5,593,157 | A | * | 1/1997 | Koros et al. | 473/606 |
| 6,457,263 | B1 | | 10/2002 | Rudy | |
| 2003/0144096 | A1 | * | 7/2003 | Lee | 473/611 |
| 2005/0205183 | A1 | | 9/2005 | Yukawa | |
| 2005/0277499 | A1 | * | 12/2005 | Tang et al. | 473/604 |
| 2006/0063622 | A1 | * | 3/2006 | Nurnberg et al. | 473/604 |

* cited by examiner

*Primary Examiner*—Steven Wong
(74) *Attorney, Agent, or Firm*—McCarter & English, LLP

(57) ABSTRACT

The present invention provides an inflatable article having a gas impermeable membrane of one or more layers and a sealable valve, including a cap plug design adapted for insertion into the valve, to reduce leakage. The invention also relates to a method for inflating inflatable articles in order to obtain specific article pressure and retain such pressure for an extended period of time

25 Claims, 5 Drawing Sheets

INFLATABLE ARTICLES THAT PROVIDE LONG TERM INFLATION AND PRESSURE CONTROL

CROSS REFERENCE TO RELATED APPLICATIONS

This application claims the benefit of U.S. Provisional Application No. 60/657,368 filed Mar. 1, 2005; U.S. Provisional Application No. 60/658,094, filed Mar. 3, 2005; U.S. Provisional Application No. 60/695,582, filed Jun. 30, 2005; U.S. Provisional Application No. 60/695,768, filed Jun. 30, 2005; and U.S. Provisional Application No. 60/697,701, filed Jul. 8, 2005 the contents of all of which are incorporated herein by reference.

FIELD OF THE INVENTION

The present invention relates to inflatable articles exhibiting enhanced pressure retention. More specifically, the present invention provides an inflatable article having a gas impermeable membrane of one or more layers and a valve and cap plug design to reduce leakage from the valve. The invention also relates to a method for inflating inflatable articles in order to obtain specific article pressure and retain such pressure for an extended period of time.

BACKGROUND OF THE INVENTION

It is well known that inflatable articles inflated with air tend to go flat in a very short period of time ranging from a few days to a few weeks. Obvious examples include the deflation of party balloons or the need to re-inflate soccer balls between weekly matches. In fact, most traditional or conventional game balls lose air over time and fall out of game specifications within weeks or months. For example, traditional basketballs lose over fifty percent (50%) of their air pressure in just one year.

One cause of such fast loss of inflation pressure is due, in part, to seepage of gas molecules through the ball membranes due to, among other things, seam defects, defective materials, and defective construction techniques, including incomplete cure and degradation of the polymer, resulting in bladder seam leaks.

Another cause of such inflation pressure loss is poor valve construction. Some if not all inflated articles have "passive" self-sealing valves, which use a valve construction and design to provide a passageway for a seal breaking device such as a ball inflation needle. The seal itself is achieved by means of a cut slit forming two flat parallel surfaces that are squeezed together by circumferential forces delivered by means of fitting an elastomeric valve body into a surrounding elastomeric housing that is tapered towards the bottom and designed to apply an interference fit. The application of this force, created by the valve housing constraining the valve body, helps squeeze the two parallel seal surfaces together. Unfortunately when the inflation needle is inserted or removed from this configuration it can induce dirt into the seal surface passageway or create uneven stress gradients in the rubber or elastomeric material of the seal surfaces that create micro-channels for air or inflation gas to directly escape to atmosphere. Another cause would be cut defects in the valve seal surfaces from using inadequately sharpened blades or a misalignment in the valve mold register during the seal passage cutting process. All these problems with the valve and seal system can cause the ball or inflated article to rapidly loss pressure.

It is known in the art that the use of large molecule gases (either alone or in combination with air or other gases) improves pressure retention in inflatable articles. Examples of such uses can, for instance, be found in the following issued U.S. Pat. Nos. 4,098,504; 4,300,767; 4,340,626; 4,358,111; 4,513,803; 5,227,103; 5,356,430; 5,578,085; and 6,457,263.

As is well known in the art, however, when inflatable articles are filled with a more dense non-air gas and are subjected to impacts, for example while bouncing a ball, the component and/or material configurations along with hard shell or dimensional attributes and the in-use environments are conducive to the generation of increased levels of noise from the article (see for example U.S. Pat. No. 4,300,767). In most instances, the noise level is increased for particular frequencies in the overall sound spectrum of the inflatable article. The decibel level of these affected frequencies can make the inflatable articles sound unpleasant, creating a ringing, pinging or otherwise sound that is considered unsuitable for the desired article's use, environment or consumer appeal. Attempts have been made to minimize this problem. For instance, Reed et al., as set forth in U.S. Pat. No. 4,300,767, discloses a method of dampening unwanted acoustic resonance caused by the use of $SF_6$ in the inflated article. The problem however was not fully solved as the solution of Reed et al. only addresses resonant frequencies greater than 2000 Hz. However, there are significant resonant frequencies occurring at the 0-2000 Hz range which are not absorbed by the Reed et al. solution. While such resonant frequencies become more and more noticeable as the size of the inflatable object increases, even in smaller balls, low resonating frequencies are still present. Further, and perhaps more importantly, the solution of Reed disrupts the symmetry of the inflatable article, in Reed's case, a tennis ball.

When inflated articles are inflated with a gas mixture other than air for the purpose of providing long term inflation and pressure control of the inflated article, however, they have a tendency to induce a significant change in performance as a result of the gas mixtures' deviation from typical air properties. For example, the feel of a soccer ball filled with a gas mixture comprising a large bulky, low permeability gas gains liveliness or, the shock absorption or bounciness of a bicycle tire changes when it is filled to its normal riding pressure with a low permeability gas mixture. These changes make the final inflatable article unsuitable because of feel, touch, comfort, control and other tactile or sensual effects that comprise a person's appreciation for comfort, playability and suitability. Such changes in the inflatable article's weight, apparent hardness, bounciness, liveliness and comfort can be become reasons for unsuitability.

There is thus a clear need for inflatable articles that remain inflated for extended periods of time, and that are inflated by a method resulting in pressure control, wherein these articles emanate minimal or, more preferably, undetectable pinging or ringing noises upon impact and retain standard, accustomed-to liveliness or playability characteristics.

SUMMARY OF THE INVENTION

In one aspect, the invention is directed to a pressurized inflatable article comprising: a gas impermeable inflation membrane comprising one or more layers or chambers and an interior wall, said membrane defining a hollow cavity comprising a compressible gas and an internal symmetry; and one or more acoustic pads adhered to said interior wall such that the internal symmetry of said article is not disrupted.

In another aspect, the invention is directed to a method for inflating at least one inflatable article with a compressible gas, the method comprising: (A) partially deflating said article; (B) inflating said partially deflated article with atmospheric gas to a fixed absolute pressure having a bias higher than atmospheric pressure to obtain said article's ultimate volume; and (C) inflating said atmospheric gas inflated article with at least one low permeability gas to a target pressure for said article.

In an even further aspect, the invention is directed to an inflation needle comprising a protruding profile adapted to cause an interfering fit with a valve of an inflatable article, whereby said needle is not readily removable from said valve during inflation.

In another aspect, the invention is directed to a sealable inflation valve disposed on an inflatable article, comprising a valve needle passageway, a recessed aperture within said passageway and a cap plug device, said cap plug device comprising a protruding profile, and wherein said cap plug device is adapted to fit within the passageway such that said protruding profile and said recessed aperture form a seal surface.

In even another aspect, the invention is directed to a method of controlling liveliness of an article inflated with atmospheric gas and at least one low permeability gas, the method comprising inflating said inflatable article to a target pressure wherein said target pressure is lower than said article's target pressure if the article was inflated with atmospheric gas alone.

BRIEF DESCRIPTION OF THE DRAWINGS

FIG. 1(*b*) is a depiction of a preferred embodiment of the valve and the cap plug of the invention with the cap plug inserted into the cavity of the valve.

FIG. 1(*c*) is a depiction of a preferred embodiment of the valve and the cap plug of the invention with the cap plug inserted into the cavity of the valve and wherein said valve is set in the wall of an inflatable article.

FIG. 2(*b*) is a photograph showing an embodiment for the layout of acoustic materials attached to the internal bladder wall of an inflatable article.

FIG. 2(*c*) is a photograph showing an embodiment for the layout of acoustic materials attached to the internal bladder wall of an inflatable article.

DETAILED DESCRIPTION OF THE INVENTION

Figure 1C:
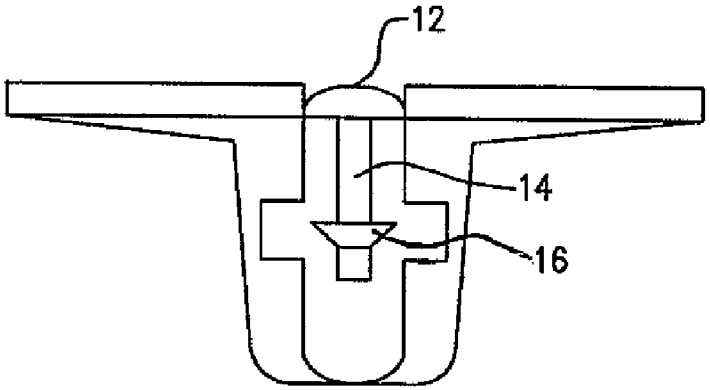
FIG. 1(*a*) is a depiction of a preferred embodiment of the valve and the cap plug of the invention prior to insertion of the cap plug into the valve.

The present invention provides an inflatable article, such as a sports ball or a bicycle tire, exhibiting enhanced retention of twenty times (20×), and as much as two hundred times (200×) longer than conventional pressurized inflatable articles, and a method for such inflation thereof. This invention further provides in an article having a minimal need to be re-inflated, producing maintenance-free performance and making the article, such as a sports ball, immediately available for use. An inflatable article of the invention is ready for use at all times, even if sitting unused for months. One basis for the improved pressure retention of the present invention is the persistent and residual benefit of using a membrane having imbibed therein low permeability gas that slows down air permeation through said membrane. Specifically, the low permeability gas condenses on the surface of the internal wall and blocks larger channels in the membrane to prevent or obstruct air permeation.

Enhanced pressure retention is produced utilizing one or more of the following features: a new inflation gas system, an improved membrane construction which reduces gas seepage, a redesigned inflation valve or orifice and cap which eliminates leaks, etc. or various combinations thereof.

In a preferred embodiment, the present invention is directed to a pressurized sports or game ball (i.e., basketball, volleyball, football, soccer ball, racket ball, rugby ball, tennis ball etc.) having improved pressure retention. The sports ball includes a generally gas impermeable elastomeric membrane comprising one or more layers which are arranged in a manner to define a cavity for containing a compressible inflation gas. The inflation gas can be added to the cavity through a valve and/or during the initial manufacturing process.

The invention relates to inflatable devices comprising pneumatic enclosures that are made of one or more layers of film or sheet elastomeric or plastic or stretch plastic materials and that are surrounded by the atmospheric gas at atmospheric pressure of 14.7 psig. The inflatable articles form enclosures, which are fully inflated to a desired pressure using a gas mixture comprising at least one low permeability gas and the atmospheric gas (e.g. air).

In one aspect, the energy in the inflated article of the invention is maintained in a controlled and balanced initial state for a substantial period of time (in excess of years) by achieving, at the time of inflation, an equilibrium between the air inside the inflatable device and air outside the device, while also balancing the energy of the non-air gases contained within the article with the compressive energy of the elastomeric and plastic membranes and casings that exert a containing force on the contained gas. The selective diffusion process of the invention allows the air to freely traverse the inflatable devices' chamber walls while preventing to a very large extent the diffusion of the low permeability, large non-polar, bulky gas molecules through the polymer matrix that forms the chamber's walls. The net effect is that there is no change in potential energy of the internal chamber, thus creating a perfectly balanced dynamic with air diffusion in and out of the chamber at a sustainable and counterbalancing rate. In concert, the large molecules of non air gas are selectively prevented from escaping, except at a very low permeation rate, by virtue of their non polar, large size, bulky shape, low solubility, and low plasticization effect on the relatively densely packed polymer chains in the chamber walls. The large molecules' net potential energy change is zero since they are counterbalanced by the materials' compressive strength in the chamber walls, its membrane layers and any outer casing that exists over the membranes.

Bladder Construction

The bladder/membrane of the invention is generally gas impermeable because upon inflation of the inflatable article, the bladder or membrane of the article is imbibed with molecules of the low permeability gas, whereby the imbibed molecules slow down air permeation through the bladder or membrane.

Typical sheets of films for producing bladders, membranes and other chambers of inflatable devices, and which function synergistically with low permeability gases, can be selected from a variety of elastomeric materials.

The elastomeric material of the chamber can be selected from any one or more of the following elastomers or a combination or alloy of them: polyurethane thermosetting and thermoplastic types, polyester elastomer, fluoroelastomer, neoprene, butadiene acrylonitrile rubber, acrylonitrile buta styrene rubber, butadiene styrene rubber, diene rubbers, styrene buna rubber, styrene acrylonitrile rubber, Nitrile butadiene rubber, ethylene propylene polymer, natural rubber, gum rubber, polyisobutylene rubber, high strength silicone rubber, low density polyethylene, low selectivity adduct rubbers, sulfide rubber, methyl rubber or thermoplastic rubber.

The chamber walls can be formed partly or entirely of a plastic or stretch plastic material or a number of layers including either an elastomeric material, as described above, or plastic or stretch plastic material by lamination, coating, fusion, heat sealing, hot tacking, radio frequency welding, gluing, stitching or free floating covered layers.

Some examples of plastics and related materials include any one or more of the following plastic or stretch plastic materials or a combination or alloy of them: chlorinated polyethylene film, polyvinyl chloride film, chlorosulfonated polyethylene/ethylene vinyl acetate copolymer, polyamide, polyimide, polyethylene (high and low density), polycarbonate, vinyl, fluorinated polyethylene, fluorinated polypropylene, polyester film, polyolefin film, polyethylene terepthalate, epoxy resins, polyethylene acid copolymers and adducts thereof.

It is further contemplated that the use of nanotechnology is applicable to the present invention. For example, said elastomeric or plastic materials referred to above can be partially filled or not filled with combinations of nano-particles derived from known sources, such as carbon, aluminum, silicates, zeolites or exfoliated clays including montmorillonites, bentonites and vermiculates.

One preferred method of eliminating leaks through the inflatable article's walls includes making the walls from overlapping sheets of elastomer or plastic or stretch plastics or combinations thereof. Other techniques to eliminate leaks include the use of, for example, rotary molds and latex dipping techniques where single lamina or multiple-layer laminates are used to impart a suitably low defect or leakage rate. Other methods include, for example, Rf welded seams, as well as glued, fused and heat pressed overlaps to name a few.

In a preferred embodiment, the bladder of the present invention specifically comprises a greater than 80% butyl content bladder/membrane having an air seepage rate at 25C and 50 psig of between 0.0050 and 0.0075 (cc*mm/hr). The membrane is preferably defect free, and has overlapping seams, end patches, and is pinhole free.

Valve and Cap Plug

The inflatable devices of this invention may be provided with valves for inflation. A common example of prior art valves includes rubber or other forms of natural or synthetic rubber/elastomer valves that form seals by pressing two parallel or interfering surfaces or slit-cut surfaces together. Such valves function by means of applying a sealing force derived from an interference fit of the valve body into a tapered or constrained valve housing that focuses circumferential force to the center where the two parallel or slit-cut surfaces of the valve body form the seal face of the valve. Such valves have recessed apertures that are designed to help guide the inflation needles or other such inflation devices to the seal surface so that with adequate lubrication and application of pressure the devices can break the seal and be inserted into the inflatable articles. The articles can be inflated by passing inflation gas and/or air through these inflation devices.

The present invention provides an inventive cap plug device that is adapted to be inserted into the recessed aperture of a valve body that is used to help guide the aforementioned inflation needle into the valve during the inflation process. Such inventive cap plug device is effective in significantly reducing leakage from inflation valves. In particular, the cap plug comprises a cap on a plug body that can be designed to fit over the recessed passageway of the valve body to prevent any dirt or other small extraneous particles from entering the inflatable article's valve passageway, thus preventing the ingress of foreign matter into the main valve sealing surfaces and preventing poor sealing and leaks.

In one embodiment, the cap plug of the invention can be shaped to form an interference fit with the internal diameter of the recessed passageway in the valve body that guides the inflation needle to the valve seal surfaces. In addition the plug portion is preferably shaped to form a seal surface inside the valve passageway by creating a seal surface that is perpendicular to the axis of the length of the passageway. This seal surface can be relatively small or, alternatively, large enough to fit the requirements of the secondary or primary seal for the inflatable article. Also the plug's seal surface is achieved by creating a recessed aperture inside the valve passageway that is of larger diameter than the passageway and is designed to fit the plug's sealing surface's material, structure and shape.

Figure 1B:
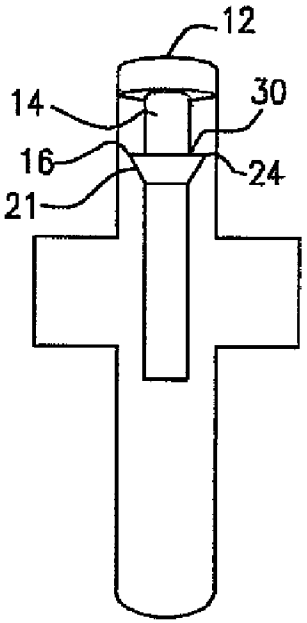
Figure 1A:
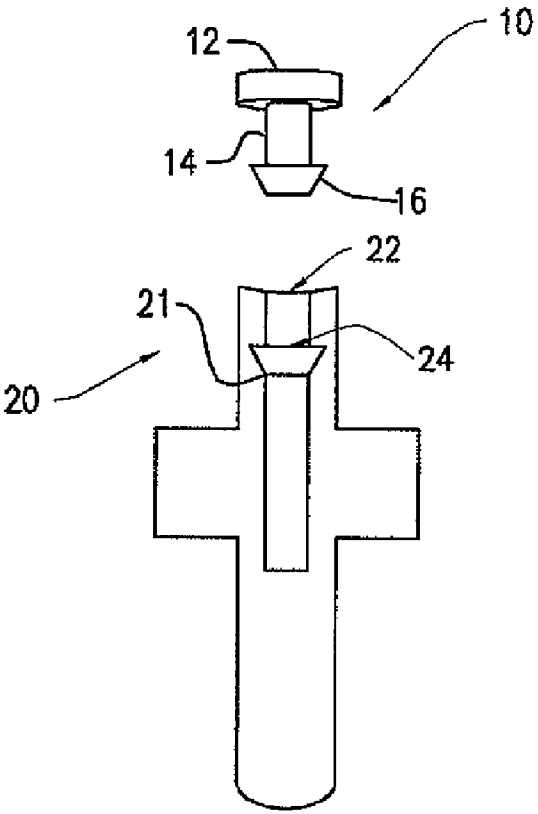

Referring now to FIGS. 1(*a*), (*b*), and (*c*), the cap plug 10 preferably comprises a cap 12, a plug 14 and a beveled protruding profile 16 disposed on the plug 14, The cap plug 10 can be made from any plastic, metal or other rigid material, but is preferably made of a flexible material such as rubber. The cap plug 10 is adapted to be inserted into the valve passageway 22 of a valve 20 to form a seal within the valve 20. The preferred valve 20 structure includes a recessed aperture 21 within the valve passageway 22 forming an interference fit surface 24. The interference fit surface 24 is adapted to form a seal surface 30 with the beveled protruding profile 16 upon insertion of the cap plug 10 into the valve passageway 22. Preferably, the beveled protruding profile 16 is shaped to form a snug fit within the recessed aperture 21, this forming a more effective seal surface 30. The seal surface 30 formed within the valve passageway 22 further inhibits the leakage of gas from the valve 20. It is preferred that a rubber or other similar flexible material be used for construction of the valve 20 in order to allow enough flexibility for insertion and removal of the cap plug 10 and induction of a seal, while also providing enough rigidity to retain its form after repeated insertions and removals, which ultimately keeps the cap plug 10 from readily slipping out.

When the cap plug 10 of the invention is fitted into the valve passageway 22 even if the valve seal surfaces were not properly aligned because of residual material or deformation caused by insertion of an inflation device, the inflation pressure of the inflatable articles are not lost because the interference fit 24 and seal faces 30 between the plug and valve body can maintain a seal pressure of up to at least 200 psig and can easily be designed to sustain even higher pressures if desired. Also unlike simple plastic wedge type plugs used in, for example, exercise balls, this plug design is held in position by the recessed seal surface that is positioned in opposition to the direction of the force exerted by the internal pressure of the inflatable article or ball further strengthening the seal surface. Plug blow out or removal pressure can be easily designed to be in the range from 5 to 200 psig by simple changes in the design or composition of the plug body or material. For example a cap and plug of this invention will not come out of a 9 psig-inflated ball by accident during play, but by simple manipulation of the seal surface dimensions or the plug material's elasticity or mechanical properties (i.e. the material's tensile properties) the valve can be removed at 60 psig. Based on valve dimensions and cap size this would be the ideal pressure for removal by hand for that particular ball's valve configuration. For other applications or balls a different but specific removal pressure can be applied through changes in the design.

Gases

The inflatable article of the invention is filled with an atmospheric gas and at least one other low permeability inflation gas. For the remainder of this document, the atmospheric gas will be specifically referred to as air.

The low permeability gas, also referred to in this document as "large bulky gas" is preferably selected from a group of gases having large molecules and low solubility coefficients, such gas exhibiting very low permeabilities and a poor ability to diffuse readily through the densely packed polymer structures made from elastomers, plastics or stretch plastics. Some examples of long term inflation gases acceptable for use in this invention include, for instance, hexafluoroethane, sulfur hexafluoride, perfluoropropane, perfluorobutane, perfluoropentane, perfluorohexane, perfluoroheptane, octafluorocyclobutane, perfluorocyclobutane, hexafluoropropylene, tetrafluoromethane, monochloropentafluoroethane, 1,2-dichlorotetrafluoroethane; 1,1,2-trichloro-1,2,2-trifluoroethane, chlorotrifluoroehtylene, bromotrifluoromethane, and monochlorotrifluoromethane. The low permeability gas provides the working pressure for the inflatable device and provides the chamber's wall with the necessary internal resistance from collapsing. Air selectively diffuses out of the chamber into the ambient air outside the device and is balanced by a likewise inward diffusion of the same from the time of initial inflation or within a short time after initial inflation. The partial pressure of air in the enclosure strives to be in equilibrium with the atmospheric pressure outside the enclosure.

In a preferred embodiment, the compressible inflation gas of the invention comprises sulfur hexafluoride ($SF_6$) gas in combination with air. Preferably, sulfur hexafluoride is present in an amount of from about 25 volume percent to about 50 volume percent, more preferably from about 30 volume percent to about 45 volume percent. As described earlier, the molecules of the sulfur hexafluoride gas are of a large molecular size. As a result, the molecules of sulfur hexafluoride have a difficult time in permeating through the walls of the elastomeric membrane. This results in low gas permeability and enhanced gas retention in the cavity of the article.

Pressure Retention

The large bulky molecules of the low permeability gases of the invention tend to reside close to or on to the internal surface or wall of the bladder/membrane in preference to the air molecules because of their high density and mass. In this locality, and particularly once condensed onto the surface, the large bulky molecules block the approach of the other gas and air molecules onto the membrane surface. This boundary layer of blocking gas slows the air permeation rate from the ball's internal cavity into the membrane and later out to the outside atmosphere. In addition to this blocking on the surface of the bladder, the large condensed molecules of the large bulky low permeability gas begin to penetrate into the supramolecular structure of the membrane seeking out the larger channels for permeation through the membrane and eventually become imbibed in the membrane. Ultimately these large channels which would be significant conduits for air to permeate through the membrane are blocked by the large bulk molecules, thus leaving only the smaller channels open to air permeation. The net reduction in channels for air permeability results is a significant reduction in permeation of the air through the bladder than if the large bulky low permeability gas was not present.

Acoustics

When the inflatable articles of this invention are inflated with low permeability gases, subtle changes in the inflated articles acoustics occur. The low permeability gas components generally show a significant reduction in the compressibility factor and a reduction in the polytropic compression behavior versus air. Other properties related to the sound include a lower specific heat ratio and up to a five or six fold increase in density. These changes in the inflatable article's internal physics in combination with the articles physical structure, configuration, design, materials of construction and outside environment and usage characteristics all together create a new and sometimes unpleasant sounding article. The low permeability gas mixtures of this invention behave in a more ideal fashion when used as a pneumatic spring. For example, when bounced, the compression of an inflatable article's chamber causes the inflating low permeability gas to store so much of the energy produced when it is compressed, that it need not lose any large amount of heat to the surrounding chamber's enclosing materials. Instead, it retains the energy so that when the compressive force is released, the energy is available to expand the gas to its original volume. The low permeability gas components behave more adiabatic. Consequently, the low permeability gas mixture of this invention is a very good or efficient medium for the transmission of sound. As such, for example, a ball made to the requirements of this invention will sound louder in areas of the spectrum that are specifically associated with the materials of construction and configuration or design of the particular inflatable article.

Air, on the other hand, does not work this way. Instead, air stores less energy during compression and the two energy transfers have poor efficiency (compression and subsequent expansion back to the original volume of the gas is more polytropic and less adiabatic). Some of the energy is usually lost as heat. Thus comparing a ball inflated with air to a ball inflated with the low permeability gas mixture would show that the low permeability gas inflated ball was very noisy. The increased noise is derived from the improved efficiency of energy conversion as well as the sound reverberation or reinforcement in both the lower and higher frequency ranges. For example, in the frequencies between 20 and 6000 Hz, an air inflated article if impacted by another hard body would have a relatively smooth asymptotic curve reflecting a gradual and smooth reduction in decibel level between 60 dB and 5 dB over the frequency range 0 to 6 kHz. This example would sound like a typical thud of a basketball being bounced on a wooden basketball court. Now, if the same article were inflated with the non-air mixture of this invention without the means to modify the acoustics of this invention, it would have an underlying smooth asymptotic curve reflecting a gradual and smooth reduction in decibel level between 65 dB and 10 dB or 5 dB over the frequency range 0 to 6 kHz, but superimposed on this curve there would be a number of high decibel spikes at specific frequencies such as 620, 1000, 1317, 1650, 1967 and 2250 Hz. These sound spikes would be between 2 and 30 dB above the background spectrum for the non-air gas, but the whole spectrum would be between 2 and 10 dB above the same frequency spectrum analysis if the inflated article had been inflated with air. The combined effect of the overall louder sound and in particular the louder array of specific frequencies results in an undesirable pinging or ringing sound in the inflatable article.

This invention provides a means of controlling the sound of the inflatable article by installing sound abating or absorbing material into the inflatable article's structure such that it prevents the production of sound or alternatively absorbs it, without affecting the internal symmetry or performance of the article.

In a further embodiment, the elastomeric wall of the membrane defining the cavity containing the compressible inflation gas may also include a noise reduction or suppression material. In this regard, it has been found that the addition of the low permeability gas, such as sulfur hexafluoride ($SF_6$) gas to the pressure retention article of the invention, produces a "pinging" sound when the article, such as a basketball is bounced. This sound can be substantially lessened or removed by the addition of noise abatement material in the internal surface of the elastomeric membrane walls which form the cavity of the article. This material is of a sufficient composition and configuration to absorb and dampen the "pinging" sound generated by the article when bounced.

In particular, it has been found that the addition of acoustic material to the interior surface of the membrane walls effectively reduces the noise produced by the large molecular, low permeability gas. The acoustic material preferably conforms to the internal symmetry of the ball and absorbs noise in the highest intensity region of the ball chamber. This high noise intensity region is located in an annulus or thin boundary layer that resides close to the internal wall of the ball. By locating and fixing the acoustic material on the internal wall of the inflatable article, the weight of the acoustic material can be significantly reduced so as not to interfere with the article's playability and performance, or in other words, the internal symmetry of the inflated article is not lost or disrupted.

The acoustic material can be any sound absorbing material, although the most preferred material is made from a reticulated foam placed on the internal wall of the bladder so as not to disrupt the internal symmetry of the ball. In order to achieve this, the material weight is minimized while the noise reduction impact is maximized. Noise is eliminated where it is most intense, i.e. in a ring or annulus surrounding the internal wall of the bladder. A single source of noise inside a ball propagates linearly. As it travels, the symmetry of the system demonstrates that the noise energy resides mostly around the internal wall of the bladder. This is the most effective noise reducing location for acoustic pads. Reducing the weight of the acoustic pads improves ball performance.

Ideally to maintain the performance characteristics of the inflatable article while changing the acoustics to the required specifications it is important to use acoustic materials that possess lightweight, low-density properties. Also, it is important to provide materials with the right sound elimination/absorbing character, having very high surface area to volume ratio, high porosity per unit of material and an open pore structure to capture sound in a labyrinth of microscopic and nano-scale caverns that are ideal for sound attenuation and absorbance. The acoustic materials of the invention are preferably applied to the inner layer of the article's structure as a complete covering, partial covering or set of "acoustic pads". They can be adhered to the inner chamber's inner walls by various techniques including coating, fusion, heat sealing, hot tacking, tacking, radio frequency welding, gluing, stitching or be free floating covered layers. In addition, these sound eliminating/dampening materials can be used less effectively between any of the layers that make up the inflatable article's structure.

Examples of sound insulating or elimination materials useful in the invention include high resilience elastomers and composites that dissipate little of their kinetic energy as heat or sound when bounced. Typical examples of this include polychloroprene type rubbers that have a high coefficient of restitution and a good bounce. Others would include various elastomers like polystyrene butadiene rubber, polybutadiene rubber, ethylene propylene rubber, butyl rubber, acrylonitrile butadiene rubber and natural rubber and their adducts.

Other examples of sound eliminating/absorbing materials and techniques useful in the invention include the use of polyurethane micro fiber laminates that contain high porosity and large surface area channels for good shock and sound absorbency. Alternatively, sound absorbing filler materials can be used. These materials can be mixed into the rubber or elastomeric components of the ball. They would include various elastomeric foams, fibers, fiber windings, fibrils, non-woven fibril patches, hollow spheres, cork, plastic bubble packs and aerogels. All of the above materials and techniques, however, are difficult to implement without causing significant changes to the performance characteristics of the inflatable article, and in particular for a ball or tire product as such materials can significantly change weight and tensile properties of the components of the structure to the point that the article's performance characteristics are lost.

Sound dampening polymers can also be used to control the acoustics of the inflated article. Low resilience elastomers like polynorborene can be used in a thin layer between the inner chamber or bladder and outer casings in any of the laminated or free floating layers of the inflatable article. Such polymers have low resilience and tend to absorb or dampen the kinetic energy of an impact or bounce. They have very low coefficients of restitution and little to no bounce. They produce a small increase in their material temperature and provide a well dampened and characteristic "thud" sound upon impact. In the form of artificial leather for example in an outer ball casing they act as a very good sound absorber.

In the case of the light foams, aerogels and other light weight, high area to volume ratio materials, if the material mass is light enough, strips, cubes, webs, sails or films or other free falling or unattached components can be placed inside the inner chamber of the inflatable article to achieve the desired acoustics. Alternatively, the sound absorbing materials can be placed as semi-attached, loose films or sails inside the inner chamber's cavity or they can be attached to the chamber walls with any of the attachment processes described above.

Ultimately, the present invention has the capability to reproduce the sound of an air filled ball by using high and low frequency manipulation. For instance, low frequency manipulation is better accomplished using aerogel or high density reticulated material. On the other hand, high frequency manipulation is better achieved using lower density reticulated material.

Figure 2C:
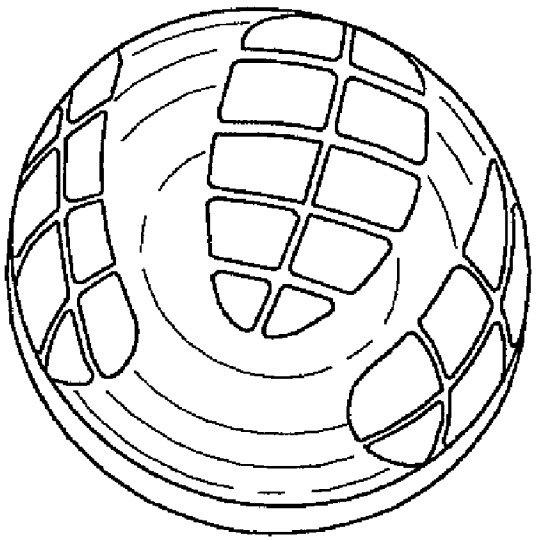
FIG. 2(*a*) is a photograph showing an embodiment for the layout of acoustic materials attached to the internal bladder wall of an inflatable article.
Figure 2B:
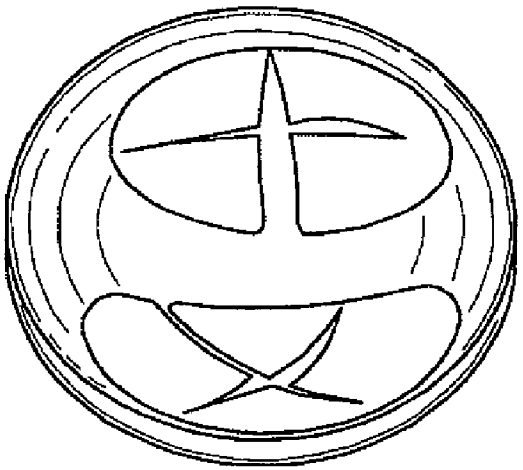
Figure 2A:
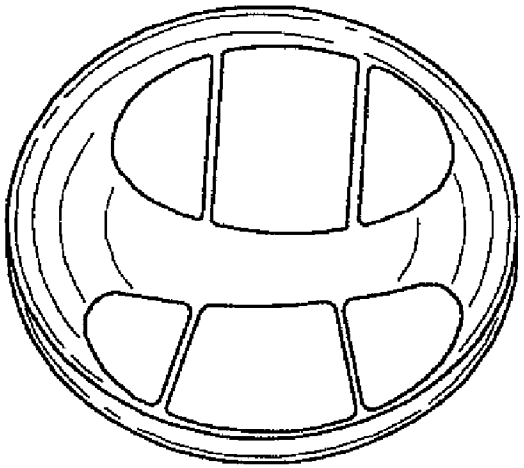

It is preferred that the acoustic materials are installed into the bladder before the bladder is formed into its final inflated form, i.e. a contiguous sphere for a ball. It has been determined, however, that during manufacture of the inflatable article, acoustic pads tend to become detached from the bladder wall because of differential stretch between the foam and the rubber during inflation. To eliminate this problem, the pads are either cut into many patterns to relieve stress or are added as many small components making up the required area of coverage on the bladder wall (see FIGS. 2 (*a*), (*b*) and (*c*)). An alternative approach is to use a textile fiber web on the back of the foam that adheres more strongly to the internal wall of the bladder.

In a preferred embodiment for use in a standard 29.5 inch basketball, polyurethane foam pads are used with a specification as follows: 0.25 in×8 in×4.5 in oval pads weighing 11 g/pad; 3 pads per ball, each with a 1.21 lb/ft3 foam density. The foam is of the reticulated polyurethane type. These pads are applied in a balanced configuration with functioning and suitable adhesive.

Inflation Procedure

To obtain an accurate target pressure of the article, and in that regard, accurate initial pressure, volume and gas concentrations, a preferred inflation method according to this invention is set forth below. The use of this method prevents dynamic variation in volume during inflation from creating inaccurate concentration and partial pressure contributions by the filling gases. In a preferred process, first, there must be a base condition with no gas or air in the inflatable article's enclosed chamber. Then, it is preferred that the chamber be inflated with air and then at least one low permeability gas to form a mixture that is specifically designed for the particular article's operating volume, pressure and physical configuration. Failure to achieve the correct volume, pressure and concentration will result in significant changes in volume and pressure over days or weeks that will be impractical for the working conditions of the article. Pressure and volume control will be outside the operating boundaries for the inflatable articles.

If the inflatable devices are not pressurized with the correct concentration of air and non air gases, the internal pressure can rise above the initial inflation pressure during the first two to three months because of the natural overall infusion of air from outside the inflatable article. Similarly, if too much air is in the inflation mixture, the inflatable article will lose pressure over one to two months or until the internal partial pressure of air equals the external ambient atmospheric pressure. Only accurate inflation of the inflatable device to the correct target of operating pressure, volume and concentrations of air and non-air gases will result in a steady dependable and controlled inflation pressure for the inflatable article.

In a preferred embodiment, the following steps are used to inflate the inflatable article by the method of the invention. While in this particular embodiment (and in other portions of this document) the inflatable article is referred to as a ball, the process of the invention is applicable to all inflatable articles.

1. It is preferred that appropriate internal ball conditions for inflation are present that present a ball with an internal pressure that is less than or equal to the current atmospheric pressure. Therefore, the ball should be partially deflated or under compression from ball construction forces. If it is not, then the ball should be deflated using the ball's compression forces or by mechanical means such as a vacuum pump or ejector type of other sources of vacuum. This procedure creates a datum point from which to fill the ball with the desired composition of gas.

2. The ball is then inflated to a fixed absolute pressure with air that has a bias higher than atmospheric pressure. It is preferred that the ball reaches its full spherical shape (to obtain the ultimate shape and constant volume for the inflated article) so that when put under pressure, the volume remains essentially constant for final gas mixture control under changing pressure. In other words, the ultimate volume of an inflatable article is the volume attained when further increases in the internal pressure result in an insignificant change in volume. It is noted that a higher pressure initial bias is useful for balls sent to high altitude locations since it allows for semi-permeable membrane deflation without degrading the ball's log term pressure retention.

3. Inflation is then carried out from the biased base pressure to the ball's target pressure using the low permeability gas (the gas mixture being controlled to provide a longer or shorter acceptable pressure retention period).

Figure 3:
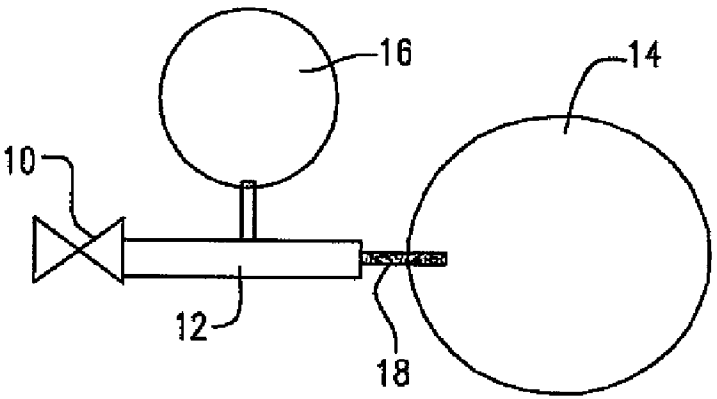
FIG. 3 is a depiction of one embodiment showing the incorporation of a pressure metering chamber disposed outside the inflatable article.

In the inflation process of the invention, the following preferred procedures may be used when inflating a sports ball, or any other inflatable article. For delivery of low permeability gas, the use of mass flow meters are effective to ensure accurate gas mixes for the required ball performance. Also, pressure control can be used by incorporating a pressure metering chamber 12 outside the ball 14 (see FIG. 3). To achieve faster inflation while retaining individual ball pressure and gas mixture control, a pressure metering chamber 12, preferably small and having a gauge 16, disposed between the gas and air valve 10 and the inflation needle 18 can be used that includes an absolute means of isolation from the gas supply system and a pressure sensing device. When inflating the ball, it was found effective to incorporate the use of pressure compensation algorithms to control inflation pressure for the particular gas mix being used.

Figure 4:
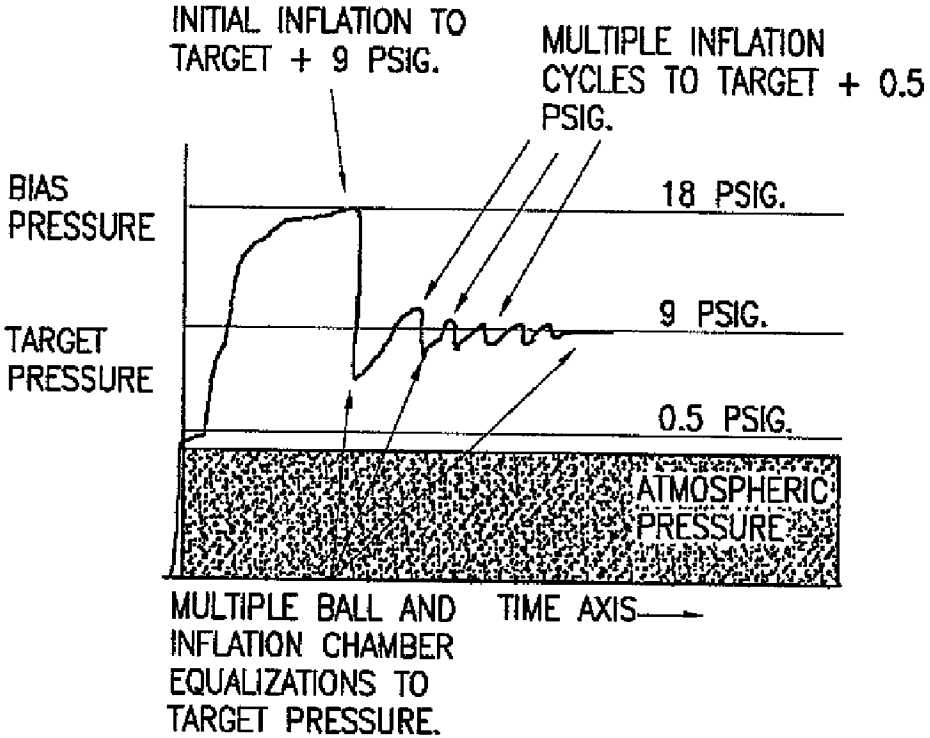
FIG. 4 is a line graph showing the measurement of increase and release of inflation pressure over time in a process of the invention for achieving equalization to a target pressure of 9 psig.
Figure 5:
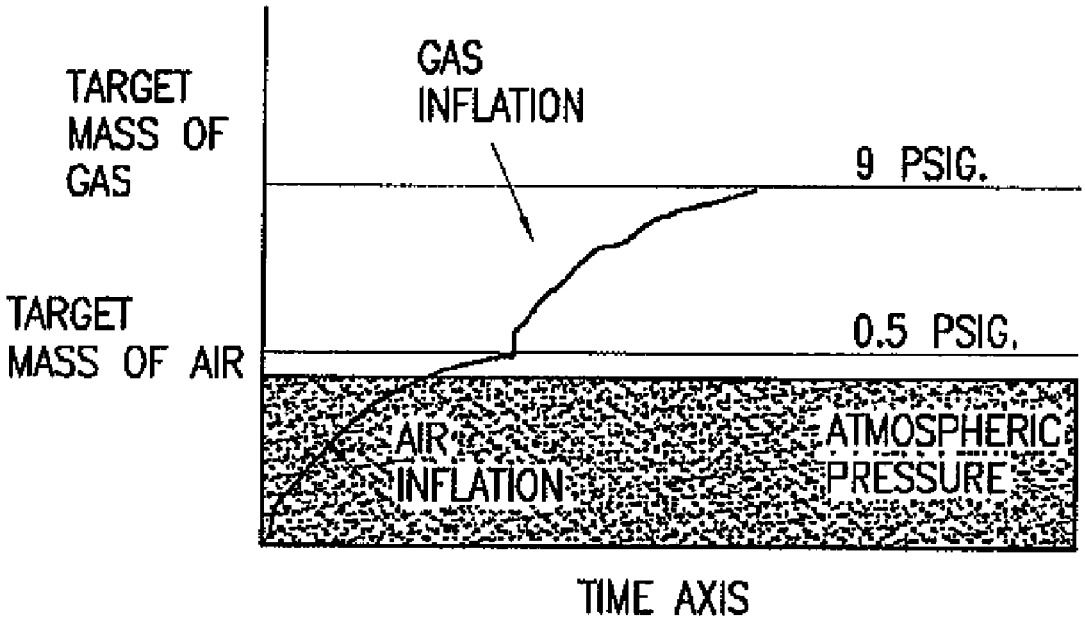
FIG. 5 is a line graph showing the measurement of increase and release of inflation pressure over time in a process of the invention for achieving equalization to a target mass of gas at 9 psig.

In the fast flow or quick inflation mode of the invention, the dynamic pressure measured outside the ball should be in the order of 2 to 4 times the actual ball pressure when nearing the target pressure of the ball (i.e. the ball's internal pressure). It is recommended that the process be halted until the external pressure metering chamber pressure is equalized with the internal ball pressure. This new steady state pressure can then be used as the process value from which to continue inflation of the ball to the target pressure using an automatic incremental inflation procedure. The iterative process then consists of inflating with gas, stopping, equalizing the ball pressure with the metering chamber pressure and repeating the process again and again until the ball is at the prescribed target pressure (see FIG. 4). In an alternative embodiment, measuring of inflation point and equilibrium point can be done by measuring the weight of the article (see FIG. 5).

The use of lower inflation pressures significantly reduces inflation cycle time because the ball's internal pressure becomes closer to the external pressure metering chamber pressure. The slower gas flow resolves control issues by eliminating pressure spikes that cause false interpretation of the pressure measurements during the inflation cycle.

These techniques can be applied to single or multiple and simultaneous ball inflations by simply adding manifolds from the same pressure sensing system to the required number of balls to be inflated simultaneously.

Inflation Needle

Figure 6:
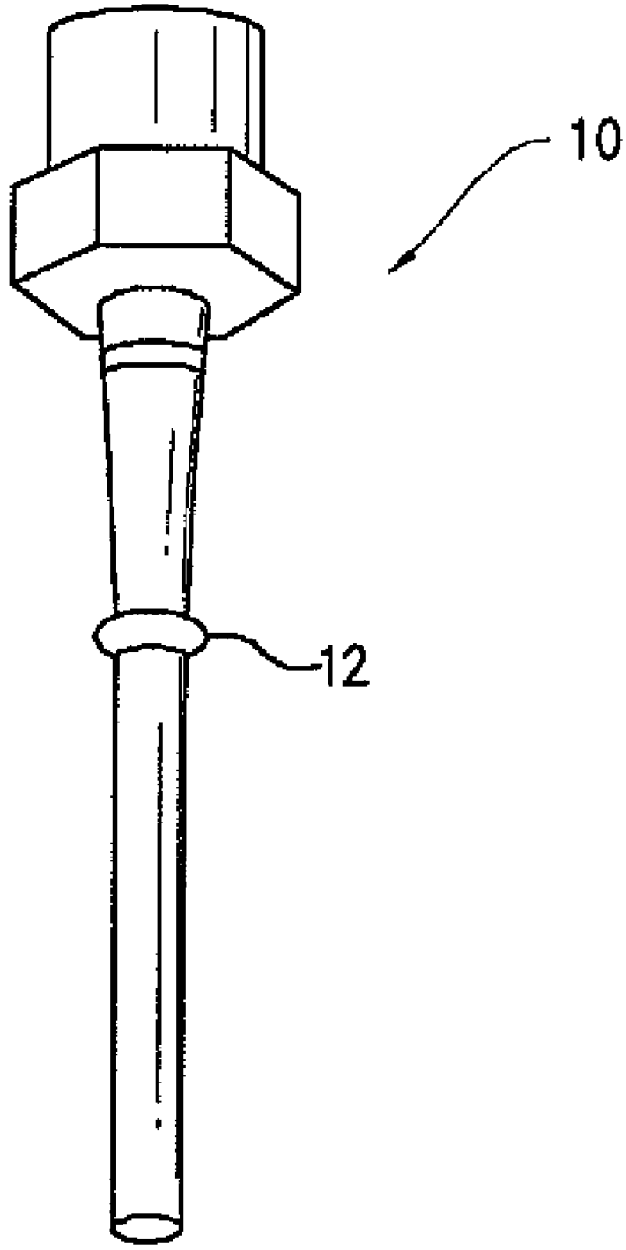
FIG. 6 is a depiction of a preferred embodiment of an inflation needle of the present invention.

In a preferred embodiment, inflation pressure control can be enhanced during the ball inflation process by using an innovative inflation needle adapted to prevent the ball from slipping off the inflation needle. In a preferred embodiment as depicted in FIG. 6, the inflation needle 10 of the invention employs a beveled or otherwise protruding profile 12 that causes an interfering fit with the inflatable article's valve or the valve's internal profile so as to prevent the article from slipping off and, as such, resulting in a smooth inflation process that is more accurate (i.e. If the ball slips off the needle the pressure inside the ball will not be on aim). In a preferred embodiment, the inflatable article is hung from the inflation needle (or otherwise adequately supported) during the inflation process so that the valve is not opened by inserting the needle against gravity. The inflation needle of the invention prevents the article from easily falling off the needle as the article hangs from said needle during the inflation process.

Customization

In another embodiment, the invention relates to a pressurized inflatable article that can be calibrated to consistently meet certain specific characteristics over time. For example, a basketball can be calibrated to match the Official National Basketball Association ("NBA") ball bounce specification, and consistently hold these specifications over time. This is unlike conventional air-filled balls which lose air on a consistent basis, resulting in a ball that falls out of game ball specifications within a few weeks or months.

Playability/Liveliness

When inflatable articles, such as balls or tires are inflated to recommended pressures used for the optimum play or comfort characteristics for the materials of construction of the articles, they may exhibit unfavorable or unsuitable playability characteristics because the original playability is correlated to the material's of construction based on pressure as a counter force to the materials compression strength. This is normally defined by an inflated air pressure. For example a rubber basketball is normally pressurized to 9 psig with air for optimal playability. If the same ball were pressurized with a gas mixture as described by this invention, the ball would have a significant increase in liveliness or bounciness related to the gases' compressibility factor and divergence from ideal gas behavior. Unlike air, the inflation gas when compressed and relieved behaves like an 'Ideal' gas spring with a low "energy loss". The selected gas mixture can store most of the energy produced in a ball's bounce (when it is compressed). When the compressive force is released, nearly all of that energy is available to re-expand the gas to its original volume. Air does not work this way, it stores less energy; the two energy transfers (compression and then expansion) have lower efficiency, and some of the energy is lost as heat. Consequently, a sports ball filled with an uncalculated gas mixture of this invention may be more bouncy or appear perhaps too lively for one playing with the ball. The ratio of the angle of incidence and the angle of deflection is closer to one (1) for a ball that is too lively. This behavior is unexpected since one would expect a ball at a certain pressure to behave the same way based on the pressure and wall construction alone.

To reduce the liveliness or excessive bounce of an inflated article, such as a ball or tire, of this invention, the inflation pressure of the article for optimum playability is reduced from the standard pressure that would be used if it were inflated with air alone. For example depending on the type of ball, its design configuration and recommended inflation pressure, the inflation pressure using a gas mixture of this invention would require a reduced inflation pressure of between 5 and 50%. For example, a basketball could require a reduction in inflation pressure of between 5 and 35% while a volleyball could require a reduced inflation pressure of between 10 and 50% to achieve the correct playability characteristics for ball control and power. Bike tires could also require reduced pressures for optimum smoothness and shock absorbance. Tires are pressurized in most cases from about 25 psig to about 125 psig. Reductions in inflation pressure between 5 and 30% could be expected to achieve better control and comfort while riding bikes. For example a 25-psig tire would require between 5 and 20% reduced pressure.

With certain inflated articles, for example balls, the combination of liveliness in the context of "off the foot speed", "speed of flight" or "power" and controllability as expressed in terms of contact time with the ball and the ability to control the directional component of the vector force when the ball is played is very important to overall performance. Ideally a ball that is fast off the foot or hand but, at the same time, is very controllable possesses the best performance. Balls with the gas mixtures of this invention possess superior power or "speed off the foot" performance to balls inflated with just air alone. This feature is explained by the efficiency of energy conversion of the gas mixture as it compresses and expands as described above. For example, when a ball is played, the imparting energy is transferred from the athlete's contact with the ball and is absorbed into the ball's elastic material and also into the gas mixture as heat and potential energy while under compression. Once the ball leaves contact with the athlete it accelerates for a very short distance in which time the deformed ball undulates from a flattened to round to flattened shape many times until it eventually becomes round again. During these undulations the gas is expanding and compressing and incrementally releasing potential energy as bursts of momentum of the ball. Because the gas of this invention is a more efficient converter of this energy, little quantity of it is lost as heat and consequently most of it is translated into speed. This does not happen to the same extent with an air-filled ball, which loses some energy as heat during the less efficient energy conversions during the short period of undulations. Hence the air-filled ball provides "less speed off the foot" and is of lower performance.

Liveliness or "speed off the foot" can further be controlled by ball construction. For instance, if the gas-filled ball is used with a less elastic ball construction, for example a butyl or other synthetic bladder or with a harder polyurethane casing, the ball's contact interval with the athlete's foot or hand can be quite short and ball control becomes more difficult because the subsequent loss of the ability to control the balls directional vector component over the high performance ball speed or "speed off the foot". In this case a reduction of inflation pressure can move the ball playability into the optimum-playing configuration for both control and speed off the foot. Alternatively, if a more elastic ball construction is used for example a natural rubber bladder and casing construction, then the optimum playing configuration for both control and power requires less of a reduction in inflation pressure, thus improving ball speed without affecting ball control. This invention provides for reduced pressure of the gas mixture to offset the control and "speed off the foot" characteristics imparted by the gas. In other words, reduction of the ultimate pressure of the gas mixture can be accomplished by either reducing the target pressure of the gas (i.e. not inflating to standard target pressure) or releasing gas mixture from inflated article. It should be noted that with some types of ball sports it may be desirable to have very high performance power/"speed off the foot" in which case no reduction in pressure of the gas mixture is used and the maximum acceptable ball speed is attained with the desired or incumbent control characteristics of the ball or inner tube/tire construction.

EXAMPLES

Example 1

The bladder/membrane of the invention is manufactured of green rubber with a typical composition of 80% Butyl and 20% Natural Rubber. It is made from four patches or cut sheets that are designed to come together with over lapping seams to make a sphere when inflated. The green rubber patches after being laid down and pressed to form over lapping seams is cured while under low inflation pressure until the spherical bladder is formed. In this cured state the bladder is wound with polyester or nylon or similar cord to a desired length. This winding provides a certain spherical stability for the ball. The bladder with windings is then covered with a rubber carcass to form the binding layer between the ball's wound bladder and the outside surface layer. Once the outside surface material is placed on the carcass it is cured so that the winding is fixed to the carcass and the carcass to the outside surface layer of the ball.

Example 2

The acoustic pads of the invention can be manufactured from reticulated (open pore) polyether polyurethane foam with a thickness of ¼ inch. The pads are cut into oval shaped with a length dimension of 8.5" and a width of 4.5". Each oval shaped pad of reticulated foam weighs 11-12 g and there are 3 pads glued onto the internal surface of the bladder of the ball. The pads are positioned in such a way as to ensure that the internal symmetry and balance of the ball is maintained. In the case of a 4 segment/patch bladder the three pads are placed on patches that are opposite and adjacent to the patch that contains the valve. The position and configuration of the pads counterbalance the weight of the valve. The overall configuration locates the center of gravity for the bladder in the center of the ball. Less than 30% of the bladder's internal surface is covered with acoustic dampening material. The overall symmetry and ball performance characteristics are maintained.

Example 3

Taking the bladder of Example 1 that incorporates the valve of this invention and incorporating the acoustics of example 2, a ball of this invention is manufactured as follows:

While making the bladder from four patches or cut sheets that are designed to come together with over lapping seams, a valve of this invention is placed into a cut hole in the bladder's preformed green rubber sheet. Three acoustic pads are placed on patches that are opposite and adjacent to the patch that contains the valve. The position and configuration of the acoustic pads counterbalance the weight of the valve. The overall configuration of the pads and valve locates the center of gravity for the inflated bladder in the center of the ball.

The green rubber patches with the incorporated valve and acoustic pads after being laid down and pressed to form over lapping seams is cured while under low inflation pressure so that the spherical bladder is formed. In this cured state the bladder is wound with polyester or nylon or similar cord to a desired length. This winding provides a certain spherical stability for the ball. The bladder with windings is then covered with a rubber carcass to form the binding layer between the ball's wound bladder and the outside surface layer. Once the outside surface material is placed on the carcass along with any decals or stencils, it is cured while under low inflation pressure so that the winding is fixed to the carcass and the carcass to the outside surface layer of the ball. This finished ball is then taken to a ball inflation station either in a partially inflated or deflated state. The ball is placed on a ball valve inflation needle and its internal pressure is measured automatically. The ball is vented to atmosphere. It is then pressurized by inflation of air to a bias pressure that is higher than atmospheric so that the ball achieves an ultimate volume that is predetermined by testing for that specific ball. This ultimate volume is the volume at which any additional increase in pressure results in relatively no change in internal volume of the bladder. In this embodiment, the ultimate volume is attained while using air as the inflation medium. When the automatic inflation machine detects that the absolute bias pressure has been achieved it begins the procedure to inflate the ball at its ultimate volume from a known bias pressure above atmospheric to a target pressure of 9 psig with SF6 gas. The pressure metering equipment is located outside the ball in a small chamber that is isolated by an inflation valve from the main gas supply system. This chamber and the internal volume of the ball constitute a single contiguous volume separated by a small inflation needle that creates a significant pressure differential between the ball and the pressure metering chamber. To obtain an accurate pressure reading inside the ball, the inflation valve of the system is closed and the pressure is allowed to equalize between the ball and the pressure metering chamber. This may take, for example, anywhere from about 10 to about 250 milliseconds depending on the ball volume and inflation needle characteristics. On the initial inflation, the chamber is inflated to 18 psig, allowed to equalize pressure with the ball. The resultant equalized pressure will be less than 9 psig as gas moves from the chamber into the ball. Since the target pressure for the ball has not been reached, the system begins another iteration of inflation with the gas. The pressure in the chamber climbs to 12 psig and the system again closes the inflation valve and allows the chamber and ball pressures to equalize. The ball pressure is now closer to the 9 psig target. This sequence of inflation, equalization of the ball with the pressure metering chamber and inflation again continues until the ball is measured to be at 9 psig for more than 1 second. At this point the ball is mechanically ejected from the inflation machine and the valve plug of this invention is inserted into the valve. The ball produced with this procedure will remain inflated for more than 12 months and consistently provide rebound and other important performance characteristics required by the governing sports authorities.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A pressurized inflatable sports ball comprising:

a gas impermeable inflation membrane comprising one or more layers or chambers and an interior wall, said membrane defining a hollow cavity comprising a compressible gas and an internal symmetry, wherein the compressible inflation gas comprises a mixture of air and at least one low permeability gas; and two or more acoustic pads adhered to said interior wall and configured such that the internal symmetry of said sports ball is not disrupted, wherein the acoustic pads comprise reticulated foam.

2. The sports ball of claim 1 wherein the low permeability gas is selected from the group consisting of hexafluoroethane, sulfur hexafluoride, perfluoropropane, perfluorobutane, perfluoropentane, perfluorohexane, perfluoroheptane, octafluorocyclobutane, perfluorocyclobutane, hexafluoropropylene, tetrafluoromethane, monochloropentafluoroethane, 1,2-dichlorotetrafluoroethane; 1,1,2-trichloro-1,2,2-trifluoroethane, chlorotrifluoroehtylene, bromotrifluoromethane, and monochlorotrifluoromethane.

3. The sports ball of claim 2 wherein the low permeability gas is sulfur hexafluoride.

4. The sports ball of claim 3 wherein the sulfur hexafluoride comprises from about 25 volume percent to about 50 volume percent of said cavity.

5. The sports ball of claim 1 wherein further comprising molecules of said at least one low permeability gas imbibed within said membrane.

6. The sports ball of claim 1 wherein the membrane comprises elastomeric and plastic materials.

7. The sports ball of claim 1 wherein the acoustic pads comprise materials comprising lightweight and low-density properties.

8. The sports ball of claim 1 wherein the acoustic pads comprise material having a high surface area to volume ratio, a high porosity per unit of material and an open pore structure.

9. The sports ball of claim 1 further comprising a sealable inflation valve comprising a valve needle passageway, a recessed aperture within said passageway and a cap plug device, said cap plug device comprising a protruding profile, and wherein said cap plug device is adapted to fit within the passageway such that said protruding profile and said recessed aperture form a seal surface.

10. The sports ball of claim 9 wherein the cap plug device is removable.

11. The sports ball of claim 1 wherein the sports ball is selected from the group consisting of a basketball, volleyball, football, soccer ball, tennis ball, racquetball and rugby ball.

12. A method for inflating the sports ball of claim 1 with a compressible gas, the method comprising: A. partially deflating said sports ball B. inflating said partially deflated sports ball with atmospheric gas to a fixed absolute pressure having a bias higher than atmospheric pressure to obtain said sports ball's ultimate volume; and C. inflating said atmospheric gas inflated sports ball with at least one low permeability gas to a target pressure for said sports ball.

13. The method of claim 12, wherein, step B further comprises the step of venting said inflated sports ball to a reduced fixed absolute pressure having a bias higher than atmospheric pressure to obtain said sports ball's ultimate volume.

14. The method of claim 12 wherein the inflation of step C comprises the use of a metering chamber having a metering chamber pressure.

15. The method of claim 14 wherein step C further comprises the steps of inflating with said gas to a pressure level greater than the target pressure, halting said inflation until pressure within said sports ball is equalized with the metering chamber pressure and repeating said inflation and equalizing steps until the sports ball reaches the target pressure for said sports ball.

16. The method of claim 12 wherein said sports ball comprises a valve comprising a valve needle passageway.

17. The method of claim 16 wherein inflation steps B and C are accomplished using an inflation needle comprising a protruding profile adapted to cause an interfering fit with said valve needle passageway, whereby said needle is not readily removable from said valve during inflation.

18. The method of claim 12 wherein the atmospheric gas is air.

19. A pressurized inflatable sports ball comprising:

a gas impermeable inflation membrane comprising one or more layers or chambers and an interior wall, said membrane defining a hollow cavity comprising a compressible gas and an internal symmetry wherein the compressible inflation gas comprises a mixture of air and at least one low permeability gas;

two or more acoustic pads adhered to said interior wall and configured such that the internal symmetry of said sports ball is not disrupted wherein the acoustic pads comprise reticulated foam; and a sealable inflation valve comprising a recessed valve needle passageway, a recessed aperture within said passageway and a cap plug device, said cap plug device comprising a protruding profile, wherein the passageway is recessed within the membrane of the ball, and wherein said cap plug device is adapted to fit within the passageway such that said protruding profile and said recessed aperture form a seal surface.

20. The sports ball of claim 1 wherein said pads are substantially oval shaped.

21. The sports ball of claim 1 wherein said two or more pads consist of three pads.

22. The sports ball of claim 21 wherein said three pads are substantially oval shaped.

23. The sports ball of claim 1 wherein said pads are at least 1;4inch thick.

24. The sports ball of claim 1 wherein each of said pads weighs no more than 12 g.

25. The sports ball of claims and 19 wherein said seal surface is positioned in opposition to the direction of the force exerted by the internal pressure of the sports ball.

* * * * *